US005906521A

United States Patent [19]

Tippmann

[11] Patent Number: 5,906,521

[45] Date of Patent: May 25, 1999

[54] INDIVIDUAL WATER VEHICLE

[76] Inventor: Patrick A. Tippmann, 14 St. Francis St., Rapid City, S. Dak. 57701

[21] Appl. No.: 08/870,142

[22] Filed: Jun. 5, 1997

[51] Int. Cl.[6] ..... B63B 35/73

[52] U.S. Cl. ..... 440/6; 114/315; 114/55.56

[58] Field of Search ..... 114/315, 346, 114/55.56; 440/6

[56] References Cited

U.S. PATENT DOCUMENTS

| | | | |
|---|---|---|---|
| 3,422,787 | 1/1969 | Rush | 440/6 |
| 3,635,188 | 1/1972 | Rutkowski | 440/6 |
| 4,804,345 | 2/1989 | Lee | 440/21 |
| 5,429,359 | 7/1995 | Timperman et al. | 273/126 A |

FOREIGN PATENT DOCUMENTS

| | | | |
|---|---|---|---|
| 1578922 | 8/1969 | France | 114/315 |

*Primary Examiner*—Sherman Basinger
*Attorney, Agent, or Firm*—Gene R. Woodle

[57] ABSTRACT

An individual water vehicle is disclosed for propelling an operator through or across the surface of water. The individual water vehicle includes a case having a foot platform upon which an operator may stand. In operation, the operator is suspended in the water in a semi-submerged position. A propeller at the base of the water vehicle creates a thrust toward the center of gravity of the operator. The operator may be propelled through or across the surface of the water in a chosen direction by shifting the operator's center of gravity toward the chosen direction.

2 Claims, 2 Drawing Sheets

INDIVIDUAL WATER VEHICLE

BACKGROUND OF THE INVENTION

Field of the Invention

This invention relates generally to the area of water sports and recreation and, more particularly, to a device for supporting an individual near the surface of the water and propelling an individual through the water.

Background Information

Throughout this country and around the world millions of people enjoy playing water related sports and water related recreation. Over the years hundreds of devices have been invented and produced which enhance or promote water sports and recreation. These devices run the gamut from simple air mattresses to water slides. A large number or water sports and recreation devices are directed toward propelling people through or across the water. For example, motor boats which tow water skiers and one or two person jet skis are very popular.

Other devices for propelling individuals through or across the water have been patented. The patent to Lee, (U.S. Pat. No. 4,804,345, Feb. 14, 1989) discloses an example of such a patent. This patent includes a pair of skis which have sufficient buoyancy to support an operator on the surface of the water. The operator stands on the skis and propels himself forward by pushing downward and rearward against the surface of the water with two poles which are provided. The operation of this invention appears somewhat similar to cross country skiing on snow.

The instant invention is an individual water vehicle which is unique, original, and fills the need for a new and improved device for water sports and recreation by providing a vehicle which supports an individual at the surface of the water and propels the individual through the water.

The ideal individual water vehicle should have sufficient thrust to support an operator at the surface of the water. The ideal individual water vehicle should also be able to propel the operator through the water in a controllable manner. The ideal individual water vehicle should be simple to operate. The ideal individual water vehicle should also be fun and safe. The ideal individual water vehicle should also be durable and require little or no maintenance. The ideal individual water vehicle should also be simple to use, uncomplicated, compact, and inexpensive.

SUMMARY OF THE INVENTION

The individual water vehicle of the instant invention includes a case with a foot platform upon which an operator may stand. The case has neutral buoyancy and, when the operator is standing upon the foot platform, the operator is suspended vertically in the water with the waterline at approximately the operator's chest. A battery is provided which fits within the case. The battery may be used to power a motor also located within the case. The motor is connected to a propeller and may be used to turn the propeller. The propeller is oriented such that, when activated, it exerts an upward thrust by pushing water downward beneath the operator. An open cage is attached to the bottom of the case and encloses the propeller for safety.

One end of a control cable is attached to the case. A control handle is provided at the other end of the control cable. The control handle includes a control switch. One pole of the control switch is connected by a battery wire to the battery. The other pole of the control switch is connected by a motor wire to the motor. The battery and the motor are also connected by a wire.

In operation the operator stands upon the foot platform and holds the control handle in one hand. The control switch is activated and the motor is engaged which causes the propeller to turn. The propeller pushes water downward which causes an upward thrust on the individual water vehicle. This upward thrust tends to lift the operator. By maneuvering the knees and ankles, the operator can cause the individual water vehicle to tilt in a particular direction. For example, by pushing the knees forward the operator can cause the top of the individual water vehicle to tilt forward. This forward tilt also causes the operating plane of the propeller to tilt such that the thrust imparted by the propeller is both upward and forward. The upward and forward thrust causes the individual water vehicle and the operator to move forward through the water. The operator may cause the individual water vehicle to move in virtually any direction by simply moving the knees in the desired direction. The operator may stop the individual water vehicle by releasing the control switch.

One of the major objectives of the instant invention is to provide a new and improved device for water sports and recreation.

Another objective of the individual water vehicle is to provide a device having sufficient thrust to support an operator near the surface of the water.

Another objective of the individual water vehicle to propel an operator through the water in a controllable manner.

Another objective of the individual water vehicle is to provide a water vehicle which is simple to operate.

Another objective of the individual water vehicle is to provide a water vehicle which is fun to operate and safe.

Another objective of the individual water vehicle is to provide a water vehicle which is durable and requires little or no maintenance.

Another objective of the individual water vehicle is to be simple to use, uncomplicated, compact, and inexpensive.

These and other features of the invention will become apparent when taken in consideration with the following detailed description and the drawings.

DESCRIPTION OF A PREFERRED EMBODIMENT

Figure 1:
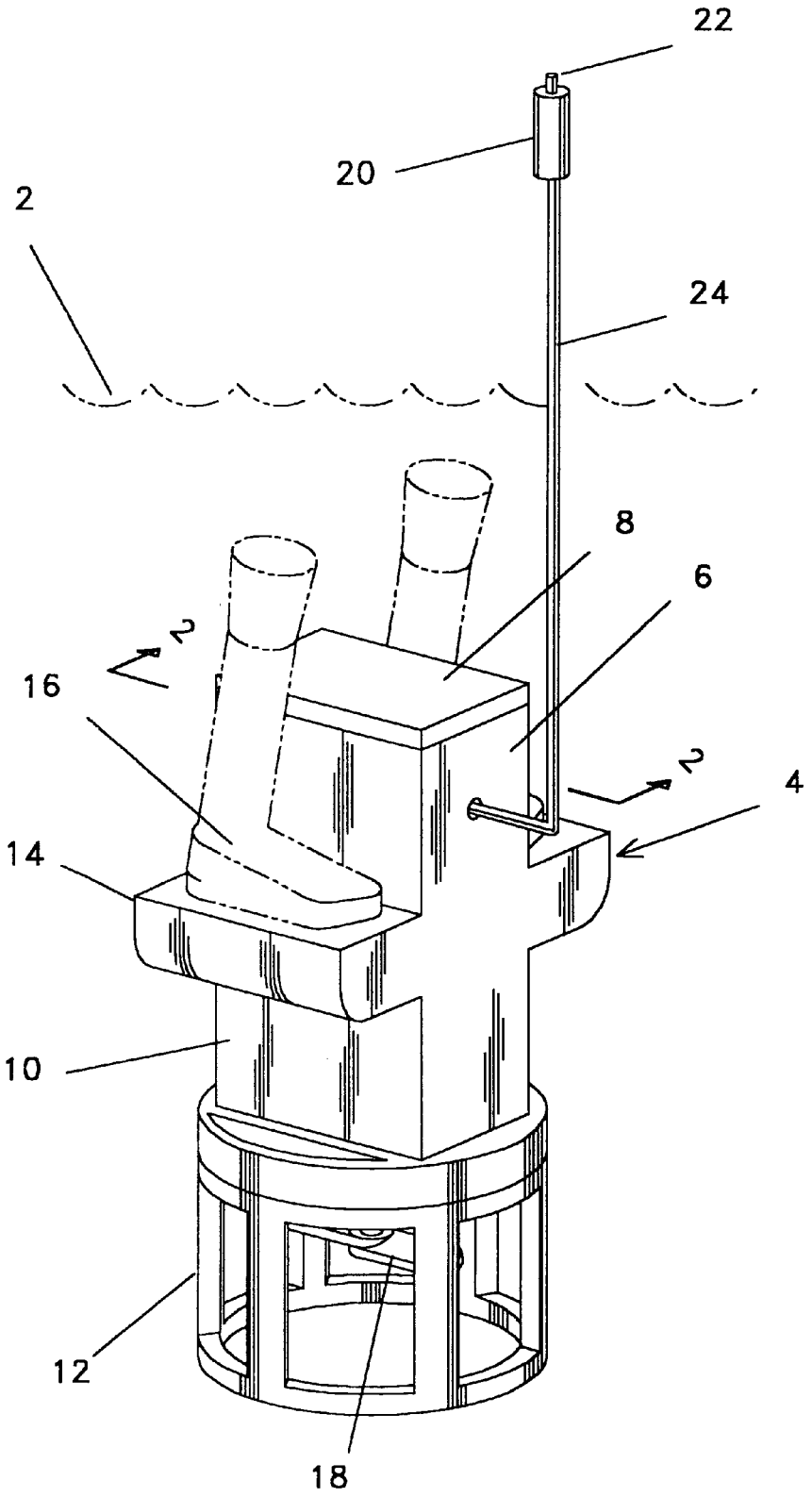
FIG. 1 is a perspective view of a preferred form of a the individual water vehicle of the present invention in operation.
Figure 2:
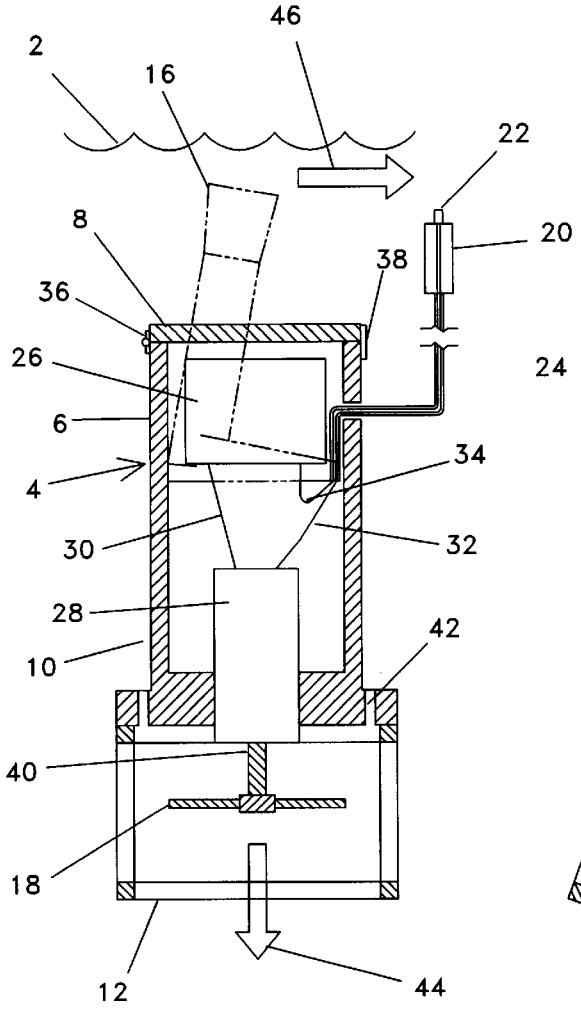
FIG. 2 is a sectional view of a preferred form of a the present invention taken along line 2—2 of FIG. 1.
Figure 3:
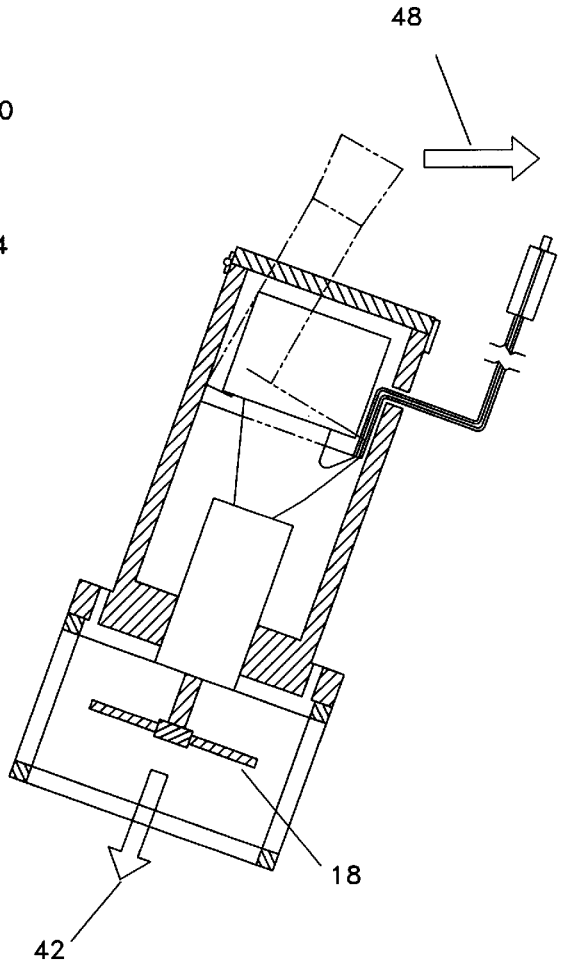
FIG. 3 is a sectional view of a preferred form of the present invention similar to FIG. 2, but showing the present invention in an alternate position.

Referring to the drawings, FIGS. 1 and 2, there is shown a preferred form of the individual water vehicle embodying the present invention. FIG. 3 shows a preferred form of the instant invention in an alternate position.

Referring to FIG. 1, a perspective view of a preferred form of the present invention in operation is shown. The invention is intended to be used in the water and, in operation, is under the surface of the water indicated by waterline 2. The invention includes a case 4 which is watertight. The upper portion of the case 4 includes a battery compartment 6 and a lid 8 which allows access to the interior of said case 4. The lower portion of said case 4 includes a motor compartment 10. An open cage 12 is attached to the bottom of said case 4. A foot platform 14 is attached to the outside of said case 4 such that the foot platform 14 creates a horizontal surface upon which an operator may stand. The feet and lower legs of such an operator are depicted in phantom lines by feet 16. A propeller 18 is enclosed by the cage 12. There is a control handle 20 having a control switch 22 attached to said case 4 by a control cable 24.

Referring now to FIG. 2, sectional view of a preferred form of the present invention taken along line 2—2 of FIG. 1 is shown. There is a battery 26 enclosed within the battery compartment 6'. There is an electric motor 28 enclosed within the motor compartment 10. A wire 30 connects one pole of the battery 26 to one pole of the electric motor 28. A motor wire 32 connects the other pole of said electric motor 28 to one pole of the control switch 22 and is inside the control cable 24. A battery wire 34 connects the other pole of said battery 26 to the other pole of said control switch 22 and is inside said control cable 24. The propeller 18 is attached to said electric motor 28. The bottom of said electric motor 28 protrudes through the bottom of said case 4. The lid 8 is attached to said case 4 by a hinge 36 and is held closed by a latch 38. Water intake slots 42 are provided to allow water to flow downward through said cage 12.

Still referring to FIG. 2, in operation, an operator, represented by the feet 16, stands on the foot platform 14 of the individual water vehicle and holds the control handle 20 in one hand. Said case 4 has neutral buoyancy and the operator is suspended vertically in the water with the waterline 2 at a point at approximately the operator's chest. The operator activates said control switch 22 and closes the circuit comprised of the wire 30, the motor wire 32, the battery wire 34, said battery 26, and said electric motor 28. Said electric motor 28 turns said propeller 18. Because the operating plane of said propeller 18 is perpendicular to the longitudinal axis of the individual water vehicle, the turning of said propeller 18 tends to push water downward in the direction indicated by arrow 44. This downward push by said propeller 18 tends to cause an upward thrust upon the individual water vehicle and the operator. This thrust causes the operator to be lifted further out of the water. The operator can cause the individual water vehicle to tilt by maneuvering the knees and ankles. For example, if the operator pushed the knees forward as indicated by knee arrow 46, the top of the individual water vehicle is tilted forward to the position shown by FIG. 3. Because of the tilt, said propeller 18 pushes water both downward and rearward as indicated by arrow 44 in FIG. 3. This changes the thrust imparted by said propeller 18 from directly upward as shown in FIG. 2, to upward and forward as shown in FIG. 3. This upward and forward thrust causes the individual water vehicle and the operator to move forward through the water as indicated by directional arrow 48 in FIG. 3. Although not shown, the operator may cause the individual water vehicle to move in virtually any direction by pushing the knees in the desired direction and causing movement similar to that described above. The operator may stop the individual water vehicle by releasing said control switch 22.

In the preferred embodiment of the individual water vehicle, said case 4 and said lid 8 are made from polyurethane foam covered by a thin layer of fiberglass; but any other material having sufficient buoyancy, strength, durability, and water resistance could be used. Said cage 12 is made from fiberglass, but other materials having sufficient strength, durability, and water resistance could be used. Said battery 26 is a conventional 7 amp gell cell battery, but other power sources could be used including sources providing lessor or greater amperage. Said electric motor 28 is a conventional 14 amp motor adapted for marine use, but other motors having lessor or greater power could be used. Said propeller 18, said control switch, said wire 30, said motor wire 32, and said battery wire 34 are all conventional and any number of readily available elements could be used provided that they are adapted for marine use. Said control handle 20 and said control cable 24 are made of tough, durable plastic. Said hinge 36 and said latch 38 are conventional.

While preferred embodiments of this invention have been shown and described above, it will be apparent to those skilled in the art that various modifications may be made in these embodiments without departing from the spirit of the present invention. For that reason, the scope of the invention is set forth in the following claims:

I claim:

1. A vehicle for propelling an operator through or across the surface of water comprising:

(1) a case having a foot platform upon which the operator may stand; the operator, when standing upon the foot platform, being in the water in a semi-submerged position;

(2) a battery within said case, (3) an electric motor within said case; the electric motor connected to and capable of being powered by the battery; and (4) a propeller attached to said electric motor and the propeller capable of being turned by said electric motor such that said propeller may create a thrust in the direction of the center of gravity of the operator;

whereby an operator may stand upon said foot platform on said case in a semi-submerged position and be propelled through or across the surface of water by shifting the operator's center of gravity toward a chosen direction.

2. The vehicle of claim 1 in which control means is provided for the control of said electric motor by the operator.

* * * * *